United States Patent [19]

Wellink

[11] Patent Number: 4,884,923

[45] Date of Patent: Dec. 5, 1989

[54] VEHICLE FOR BULK TRANSPORT OF POWDER-FORM, GRANULAR OR PELLET-LIKE MATERIAL

[75] Inventor: Theodorus A. Wellink, Groenlo, Netherlands

[73] Assignee: Welgro B.V., Netherlands

[21] Appl. No.: 184,050

[22] Filed: Apr. 20, 1988

[30] Foreign Application Priority Data

May 22, 1987 [NL] Netherlands ..... 8701241

[51] Int. Cl.[4] ..... B60P 1/60; B65G 53/40; B65G 53/46

[52] U.S. Cl. ..... 406/41; 406/39; 406/128; 406/132; 406/133; 137/243; 251/61.4

[58] Field of Search ..... 406/132, 133, 124, 126, 406/39, 41, 128; 298/27; 137/268, 243; 251/61.4, 63.6

[56] References Cited

U.S. PATENT DOCUMENTS

| | | | |
|---|---|---|---|
| 417,214 | 12/1889 | Austin | 406/132 X |
| 1,386,009 | 8/1921 | McDonald | 406/133 X |
| 2,968,465 | 1/1961 | Flick et al. | 251/63.6 |
| 3,090,593 | 5/1963 | Pro | 406/124 X |
| 3,322,142 | 5/1967 | Baumann | 251/61.4 |
| 3,429,331 | 2/1969 | Prevost | 406/126 X |
| 3,733,012 | 5/1973 | Grun | 406/133 |
| 4,236,547 | 12/1980 | Harasewych | 137/243 |
| 4,376,885 | 3/1983 | Smirra | 137/243 X |

*Primary Examiner*—Joseph F. Peters, Jr.
*Assistant Examiner*—James M. Kannofsky
*Attorney, Agent, or Firm*—John P. Snyder

[57] ABSTRACT

The invention relates to a vehicle for transport of material. To allow for the pellet-like material, such as cattle feed, to be unloaded without disturbance, the height adjustable closing member of the discharge funnel is provided with a cutting edge for destruction of pellet-like material.

15 Claims, 6 Drawing Sheets

VEHICLE FOR BULK TRANSPORT OF POWDER-FORM, GRANULAR OR PELLET-LIKE MATERIAL

Figure 1:
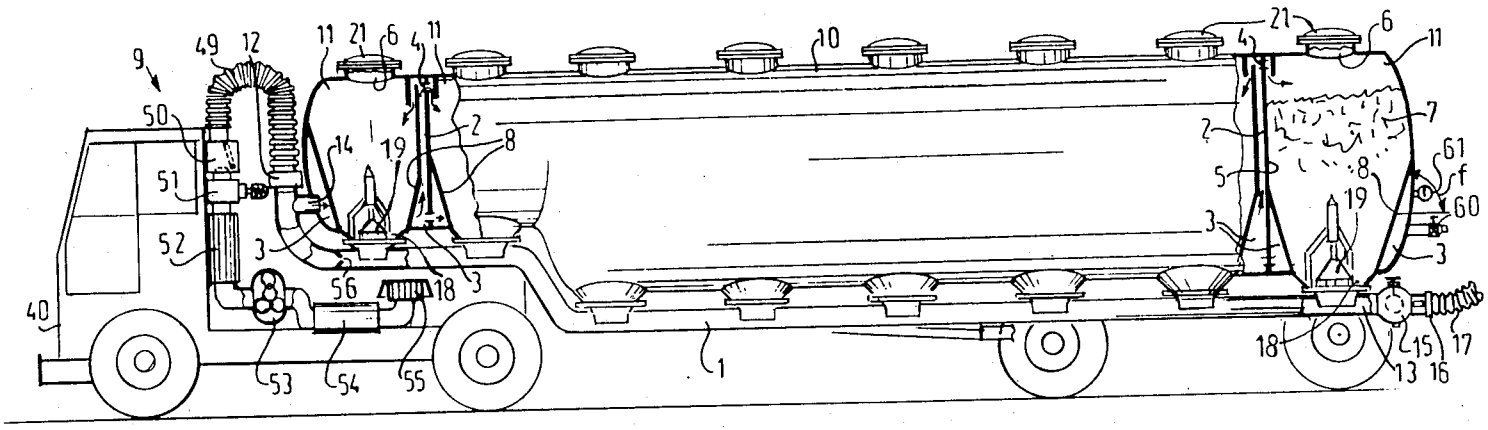

The invention relates to a vehicle with multiple reservoirs for bulk transport of powder form, granular or pellet-like material, which reservoirs each have an airtight closable filling opening and a discharge funnel, whereby each discharge funnel is connected to a common discharge pipe via at least one discharge funnel opening to be closed off by a height adjustable closing member, whereby the discharge pipe has a nozzle for compressed air and a discharge for air with material, whereby the reservoirs are connected around the discharge funnel opening and close to their top end to a compressed air source and to one another and whereby the closing member co-operates for sealing by means of an elastic sealing ring with a similarly formed periphery of the discharge funnel.

Such a vehicle is known. Here, the airtight closing of the discharge funnel is a source of problems since pellet-like or granular material nestles between the closing member and the sealing ring, which results in air being able to leak out such that the pressure above the material in another compartment for unloading decreases, as a result of which disturbance and/or delay in the unloading process can occur.

The invention has for its object to design the vehicle such that the problem of air leakage through the discharge funnel opening is avoided. To this end the closing member has in accordance with the invention a cutting edge for destruction of pellet-form material. The sealing ring preferably seals relative to a downward directed peripheral surface. This avoids the danger of pellet-form material that may have been cut into fragments or pulverised causing any air leakage.

The British patent publication 922389 relates to a valve intended for sealing a funnel-shaped bottom of a silo for granular material. A two-fold closing means is thereby present, namely an upper closing member, which may not close properly owing to a pellet remaining between this closing member and a seat, and a lower closing member that can be moved relative to the upper closing member so that it does seal without hindrance from pellets. The construction of this valve is such that it is not suitable for use in a vehicle of the type referred to in the preamble.

Known from the German patent publication 1246553 is a bottom valve for a silo for granular material whereby the valve moves from the underside of the outlet opening into the closing position. A number of elastic rings disposed above one another are thereby arranged on a cylindrical peripheral surface, which sealings co-operate with a cylindrical sealing face. Two obtuse angles co-act in the closing of this valve, while there is a considerable radial distance present between the two obtuse angles. This is not a particularly good arrangement for cutting through any hard cattle feed pellets.

Figure 2:
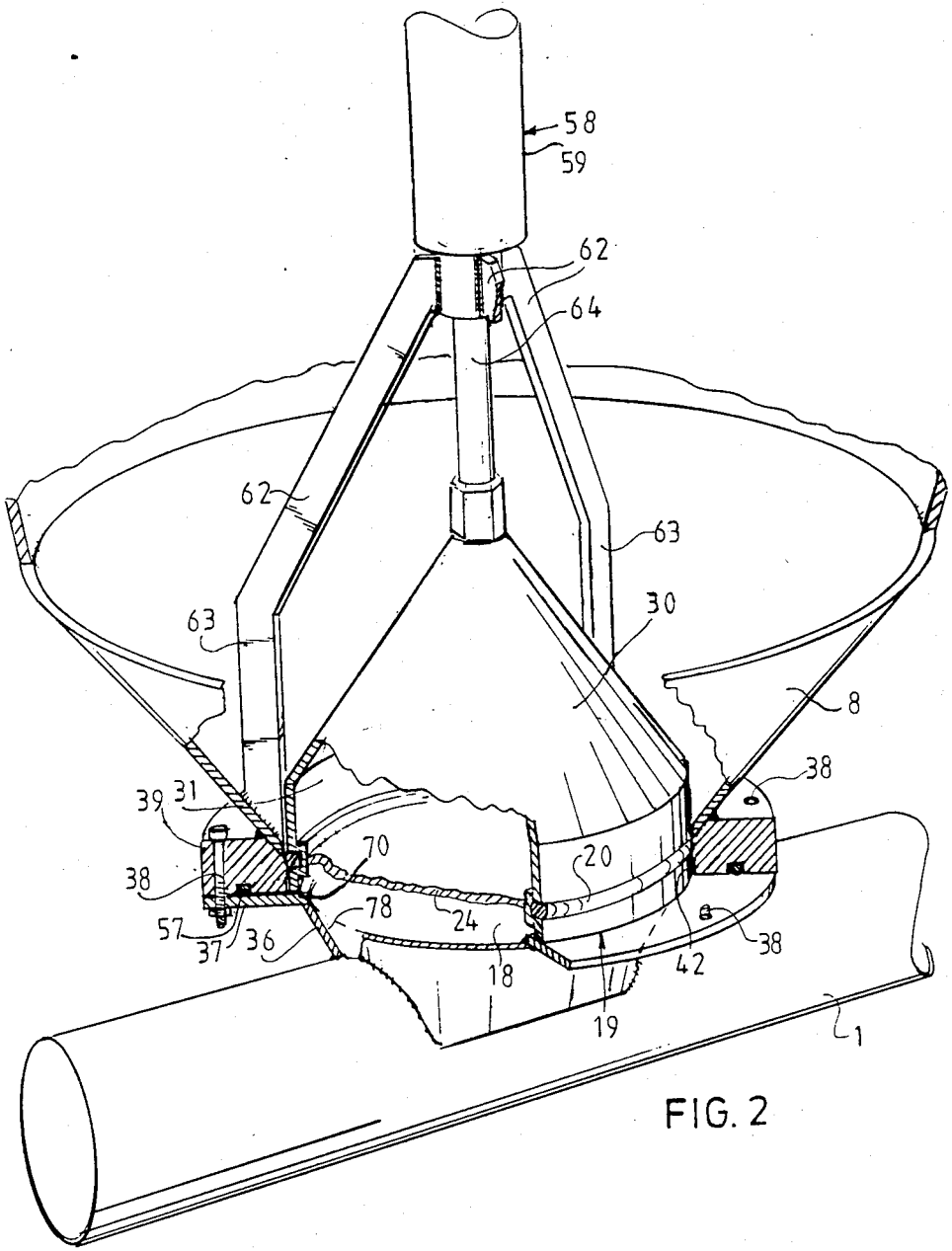
Figures 3, 4:
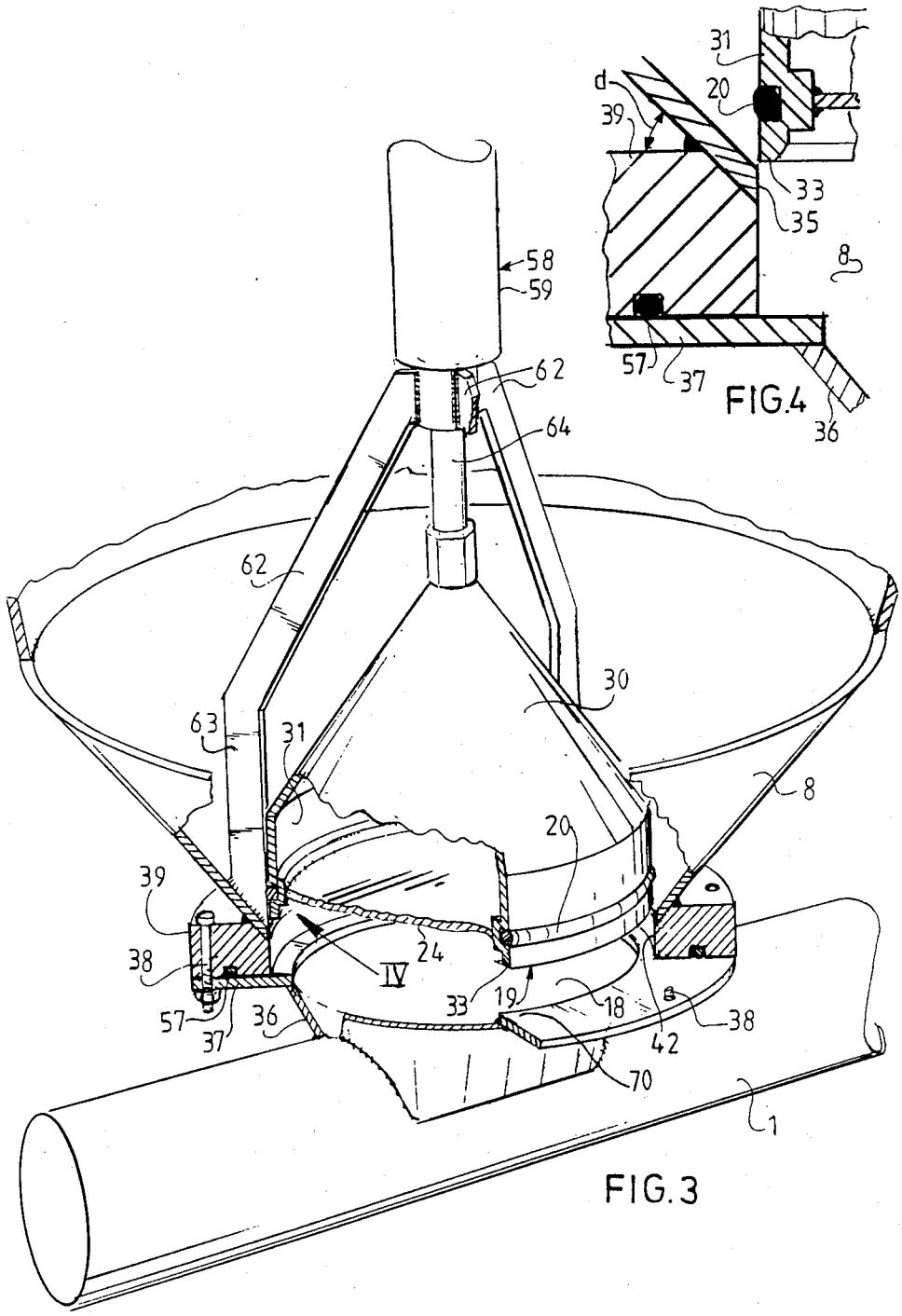
Figure 5:
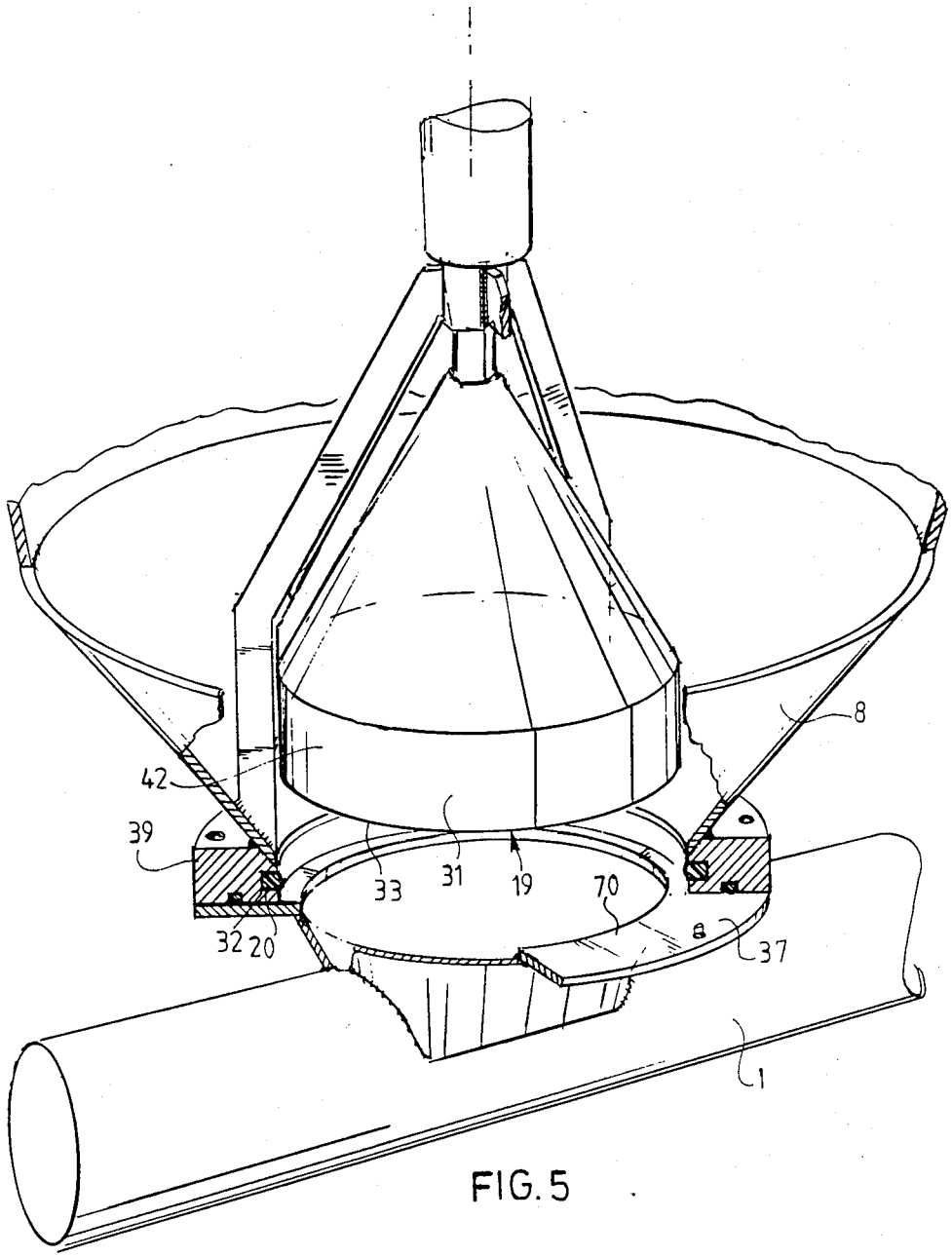
Figure 6:
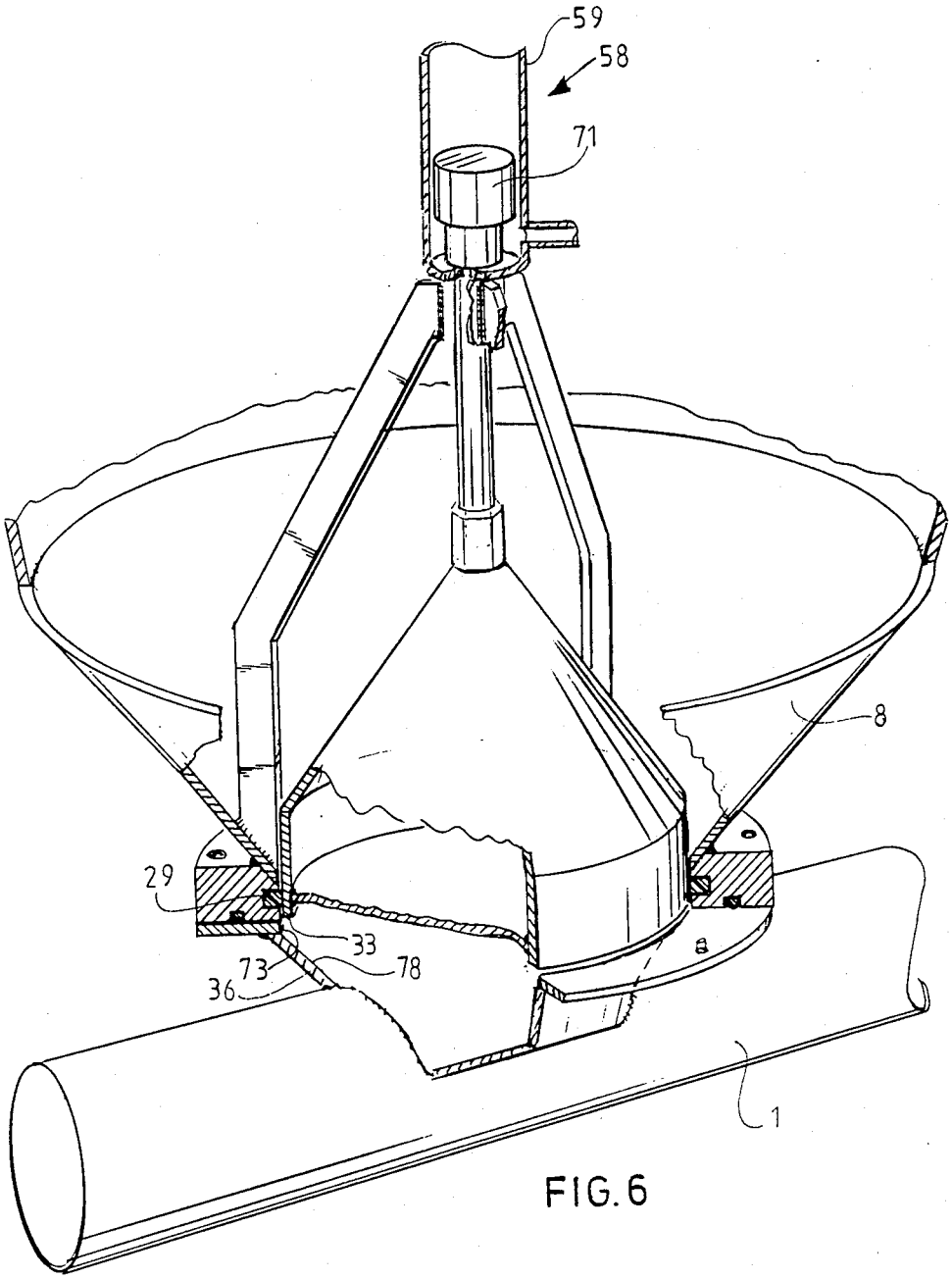
Figure 7:
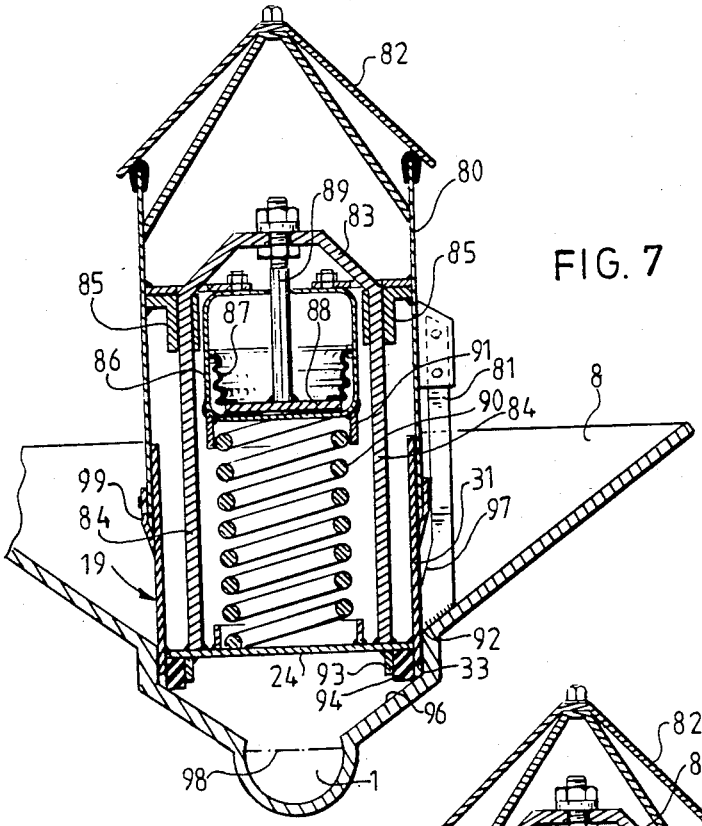
Figure 8:
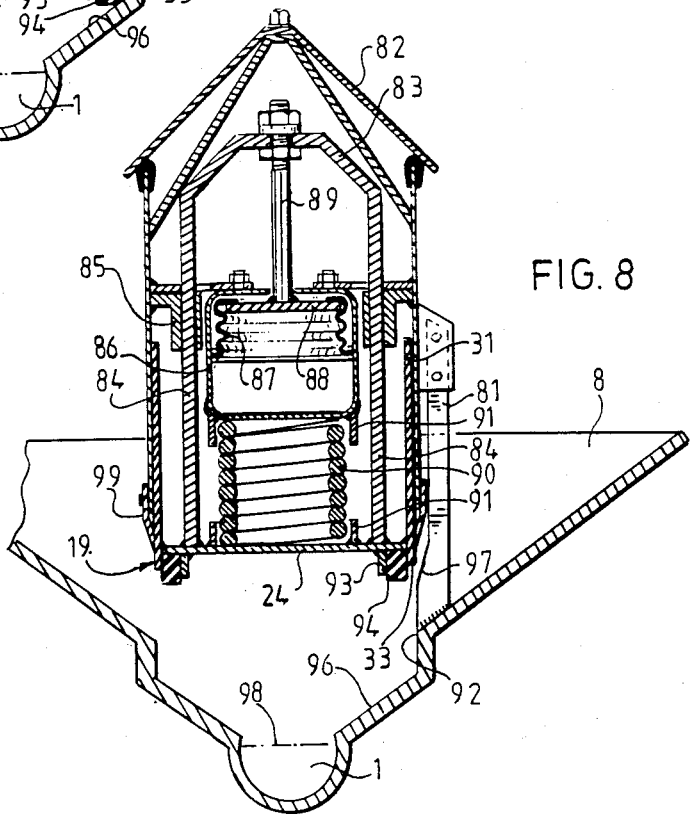

The invention will be elucidated in the description following hereinafter with reference to a drawing. In the drawing:

FIG. 1 shows a lengthwise section of a vehicle,

FIG. 2 and 3 show on a larger scale longitudinal sections along a discharge funnel of the vehicle from FIG. 1 in the closed and opened situation respectively, FIG. 4 is detail IV from FIG. 3 on a larger scale, FIG. 5 and 6 each show a longitudinal section corresponding with FIG. 2 and 3 respectively of another vehicle according to the invention, and FIG. 7 and 8 are illustrations similar to FIG. 2 and 3 of another, preferred embodiment.

The vehicle 9 from FIG. 1 is a tractor 40 with a semi-trailer 41 which carries a tank 10, Vehicle 9 may also take the form of an integral cab-tank truck or a rail vehicle.

The tank 10 is divided into eight reservoirs 11 each having on their underside a conical discharge funnel 8, the walls of which enclose at their lower ends an angle of slope d with the horizontal plane, while above this they have a greater angle of slope of with the horizontal, so that the material 7 for unloading slides automatically downward along the wall of the discharge funnel 8. Filling openings 6 of reservoirs 11 are closed airtight by means of covers 21. The reservoirs 11 are separated from one another by transverse partitions 5 and communicate with one another via air passages 4 in the top ends of transverse partitions 5. The spaces 3 of tank 10 beneath discharge funnel 8 communicate with one another and with the upper parts of reservoirs 11 via vertical air pipes 2 and the air passages 4.

Lying underneath discharge funnel 8 is a common discharge pipe 1, the front end of which is formed by a connecting device 12 for compressed air and the rear end of which is formed by a discharge 13 for air with material. Discharge pipe 1 communicates via a conduit 14 with spaces 3. The discharge 13 is connected via a stop valve 15 onto a coupling 16 for a hose 17.

Each funnel 8 is connected via a discharge funnel opening 18 onto the discharge pipe 1. This discharge funnel opening 18 can be closed off by means of a round closing member 19 which seals with a torus-shaped rubber sealing ring 20 against the vertical cylindrical inner face 42 of the flange part 39 of discharge funnel opening 8. Closing member 19 consists of a cone-shaped cap 30 which connects onto a vertical cylindrical ring 31 into which is formed a peripheral groove 32 for receiving sealing ring 20. The cylindrical ring 31 has a cutting edge 33 which co-operates for cutting or clipping with the inner edge 35 of discharge funnel opening 8 (FIG. 4). Ring 31 is reinforced by means of a round plate 24. The discharge pipe 1 has at the location of each discharge funnel 8 an outflow mouth 36 that is connected with a flange 37 and bolts 38 to the flange part 39, with the interpositioning of an elastic sealing ring 57.

The closing member 19 is driven up and down by means of a hydraulic or pneumatic cylinder assembly 58, the cylinder 59 of which is attached to the discharge funnel 8 by means of three legs 62 of which the bottom ends 63 are directed vertically along ring 31 and are welded in position on discharge funnel 8. Closing member 19 is attached to the piston rod 64. In FIG. 5 the sealing ring 20 is fitted in a groove 32 of flange part 39, so that the sealing ring 20 cooperates for sealing with a vertical cylindrical peripheral surface 42 of the ring 31 of closing member 19. Ring 31 has the cutting edge 33.

In FIG. 3–5 the closing member 19 strikes with cutting edge 33 up against the inside edge 70 of flange 37, whereby pellets and pellet remnants are pulverised.

In FIG. 6 on the other hand the piston 71 of cylinder assembly 58 strikes up against the end of cylinder 59 when the cutting edge 33 has passed sealing ring 29. There then remains free an annular space 73 below cutting edge 33 where a pellet or pellet remnant can fall undisturbed downward along the wall 78 of the inflow wall 36.

The connecting device 12 is connected via a hose 49, a non-return valve 50, a safety valve 51 and a damper 52 to a Roots blower 53 which via a damper 54 and a filter 55 sucks in much air and, at a comparatively low pressure of 0.7 to 1 bar overpressure supplies 12 to 18 $m^3$ per minute for unloading of 20 to 30 tons of bulk material per hour; this being dependent on the type of material and the carrying height and distance over which the material is transported via hose 17 into a silo. The round discharge pipe 1 has an internal diameter of 10 cm for example and is connected via a throttle 56 with an internal passage diameter of 42 to 44 mm or via a throttle valve to the connecting device 12. After the blower 53 has been set into operation and the spaces 3, the empty reservoirs 11 and the upper parts of the reservoirs still filled with material 7 have been filled with compressed air while stop valve 15 is closed, the closing member 19 of the reservoir 11 for unloading is raised to a height which depends on the length of the hose 17, the carrying height, the specific weight and the nature of the material for unloading, this preferably being done precisely such that there is no danger of hose 17 becoming blocked.

Unloading can thus always be performed at maximum unloading capacity.

It is also possible to unload two or three reservoirs 11 simultaneously. Also possible is the simultaneous transporting of different kinds of cattle feed in the separate reservoirs.

In addition to material in powder form this vehicle is particularly suitable for transporting cattle feed pellets.

The good sealing by closing member 19 of an empty reservoir 11 prevents air leakage through this latter during unloading of a reservoir 11. There is the resulting certainty that all the air supplied remains available for picking up the material 7 beneath the opened discharge funnel opening 18, while a constant maximum unloading capacity is achieved. The design is such that a discharge funnel opening 18 can be closed again, also in the case the relevant reservoir 11 is still only partially unloaded.

Present on the rear of vehicle 9 are an air-release tap 60 and a manometer 61 in addition to actuating means (not shown) for the pneumatic or hydraulic piston cylinder assemblies 58 of the closing members 19.

In the embodiment variant of FIG. 7 and 8 a round tower-like cover 80 with a peaked roof 82 is arranged by means of three vertical supports 81 in discharge funnel 8. A closing member 19 is guided in the cover 80 in vertical direction by means of a U-shaped bracket 83, the legs 84 of which are guided in fixed vertical guidings 85. Firmly connected to guidings 85 is a diaphragm housing 86. Accommodated in diaphragm housing 86 is a diaphragm 87 that is connected to a disc 88 of a rod 89 which is connected to the U-bracket 83. Between a plate 24 of closing member 19 and diaphragm housing 86 a spiral spring 90 is accommodated in rings 91, which spring forces the closing member 19 with considerable force, for example 250 kgN, into the closing position. Closing member 19 further comprises a cylinder 31 with a cutting edge 33 which cuts through feed pellets at the discharge funnel edge 92 during the closing movement. Since this takes place with a rapid closing movement, the cut pellet fragments shoot downward into the discharge pipe 1. Accommodated between cutting edge 33 and an inner ring 93 is an elastic sealing ring 94 which closes onto the round funnel surface 96. During downward movement the closing member 19 is guided by means of supports 81 which have downward converging guide faces 97. Discharge pipe 1 connects above the centre 98 onto the funnel surface 96 so that the bulk material deposited into this cut out discharge pipe 1 from a mixture flow of air and bulk material passing through here remains almost continual running, so that the flow resistance here is small. An elastic sealing strip 99 is arranged on the lower edge of cover 80 against cylinder 31. By feeding in more or less air under diaphragm 87 the rise level of closing member 19 can be adjusted in order to adapt the latter to the circumstances, such as the kind of material, the transport path and transporting height.

I claim:

1. A vehicle for transport of bulk material of powder, granular or pellet-like material comprising a plurality of reservoirs, means for filling each of said reservoirs with bulk material, said reservoirs having upper portions thereof interconnected with one another, a source of compressed air connected with said interconnected portions for discharging bulk material from said reservoirs, a discharge pipe including an outlet for discharging bulk material from the vehicle, said reservoirs having at a lower portions thereof discharge means for controlling discharge of material from the associated reservoirs, each of said discharge means including a first portion defining a discharge opening in communication with said discharge pipe and a second portion movable in a first direction with respect to said first portion to open the discharge means and in a second direction with respect to said first portion to close the discharge means, one of said portions carrying a resilient sealing ring, the other of said portions having a sealing surface engageable with said sealing ring to provide a substantially airtight seal when the discharge means is closed, said first portion having a first edge formed thereon, said second portion having a cutting edge formed thereon and engageable with said first edge prior to engagement of said sealing surface and sealing ring when said second portion moves in said second direction to close the discharge means to thereby break up any pellet-like or granular bulk material which might otherwise lodge between the sealing ring and the sealing surface and prevent an effective airtight seal.

2. A vehicle as defined in claim 1 wherein said sealing surface is substantially cylindrical.

3. A vehicle as defined in claim 1 wherein said sealing surface is tapered in a downward and inward direction.

4. A vehicle as defined in claim 1 wherein said first portion has a further part engaging said cutting edge when the discharge means is closed for pulverizing pellet-like or granular material.

5. A vehicle for transport of bulk material of powder, granular or pellet-like material comprising a plurality of reservoirs, means for filling each of said reservoirs with bulk material, said reservoirs having upper portions thereof interconnected with one another, a source of compressed air connected with said interconnected portions for discharging bulk material from said reservoirs, a discharge pipe including an outlet for discharging bulk material from the vehicle, discharge means at the lower portions of said reservoirs, each of said discharge means defining a discharge opening in communication with said pipe, said discharge means having a substantially cylindrical sealing surface and defining a first circular edge, closing means mounted for axial movement relative to said discharge means in a first direction to open the discharge means and in a second direction to close the discharge means, said closing means carrying an annular resilient sealing ring which engages said sealing surface in the closed position, said closing means having on the lower part thereof a circular cutting edge engageable with said first edge prior to engagement of said sealing surface and sealing ring when said closing means moves in said second direction to close the discharge means to thereby break up any pellet-like or granular bulk material which might otherwise lodge between the sealing ring and the sealing surface and prevent an effective airtight seal.

6. A vehicle as defined in claim 5 wherein said first edge is disposed at the upper part of said sealing surface.

7. A vehicle as defined in claim 5 wherein said cutting edge is disposed at the lowermost part of said closing means, and said sealing ring is spaced thereabove.

8. A vehicle as defined in claim 5 wherein said discharge means includes a radially inwardly extending surface for engaging said cutting edge when the closing means is in closed position for pulverizing pellet-like or granular bulk material.

9. A vehicle for transport of bulk material of powder, granular or pellet-like material comprising a plurality of reservoirs, means for filling each of said reservoirs with bulk material, said reservoirs having upper portions thereof interconnected with one another, a source of compressed air connected with said interconnected portions for discharging bulk material from said reservoirs, a discharge pipe including an outlet for discharging bulk material from the vehicle, discharge means at the lower portions of said reservoirs, each of said discharge means defining a discharge opening in communication with said pipe, said discharge means carrying an annular resilient sealing ring and defining a first circular edge, closing means mounted for axial movement relative to said discharge means in a first direction to open the discharge means and in a second direction to close the discharge means, said closing means including a substantially cylindrical sealing surface which engages said sealing ring in the closed position, said closing means having on the lower part thereof a circular cutting edge engageable with said first edge prior to engagement of said sealing surface and sealing ring when said closing means moves in said second direction to close the discharge means to thereby break up any pellet-like or granular bulk material which might otherwise lodge between the sealing ring and the sealing surface and prevent an effective airtight seal.

10. A vehicle as defined in claim 9 wherein said cutting edge is disposed at the lowermost part of said closing means.

11. A vehicle as defined in claim 9 wherein said first edge is spaced above said sealing ring.

12. A vehicle for transport of bulk material of powder, granular or pellet-like material comprising a plurality of reservoirs, means for filling each of said reservoirs with bulk material, said reservoirs having upper portions thereof interconnected with one another, a source of compressed air connected with said interconnected portions for discharging bulk material from said reservoirs, a discharge pipe including an outlet for discharging bulk material from the vehicle, discharge means at the lower portions of said reservoirs, each of said discharge means defining a discharge opening in communication with said pipe, said discharge means having a sealing surface and defining a first circular edge disposed thereabove and spaced therefrom, closing means mounted for axial movement relative to said discharge means in a first direction to open the discharge means and in a second direction to close the discharge means, said closing means carrying an annular resilient sealing ring at a lower part thereof which engages said sealing surface in the closed position, said closing means having a circular cutting edge thereon spaced above said sealing ring and being engageable with said first edge prior to engagement of said sealing surface and sealing ring when said closing means moves in said second direction to close the discharge means to thereby break up any pellet-like or granular bulk material which might otherwise lodge between the sealing ring and the sealing surface and prevent an effective airtight seal.

13. A vehicle as defined in claim 12 wherein said sealing surface is tapered in a downwardly and inward direction.

14. A vehicle as defined in claim 12 including resilient means normally biasing said closing means into closed position.

15. A vehicle as defined in claim 12 including means for moving said closing means into open position and comprising an air bellows operatively connected with said closing means.

* * * * *